United States Patent [19]

Ackeret

[11] Patent Number: 5,005,262

[45] Date of Patent: Apr. 9, 1991

[54] COMBER WITH ELECTRIC MOTOR DRIVEN INTERMITTENT FEED ROLLER

[75] Inventor: Walter Ackeret, Seuzach, Switzerland

[73] Assignee: Rieter Machine Works, Ltd., Winterthur, Switzerland

[21] Appl. No.: 406,781

[22] Filed: Sep. 13, 1989

[30] Foreign Application Priority Data

Sep. 21, 1988 [CH] Switzerland ..... 03505/88

[51] Int. Cl.[5] ..... D01G 19/08

[52] U.S. Cl. ..... 19/234; 19/235; 19/239

[58] Field of Search ..... 19/215, 216, 218, 225, 19/226, 227, 228, 229, 231, 232, 233, 234, 239, 240

[56] References Cited

U.S. PATENT DOCUMENTS

| | | | |
|---|---|---|---|
| 3,004,300 | 10/1961 | Naegeli et al. | 19/116 |
| 3,153,936 | 10/1964 | Nydam | 74/24 |
| 3,277,790 | 10/1966 | Walters | 91/35 |
| 4,079,632 | 3/1978 | Mori et al. | 74/25 |
| 4,266,324 | 5/1981 | Hasegawa et al. | 19/239 |
| 4,302,968 | 12/1981 | Moser | 19/239 |
| 4,672,717 | 6/1987 | Shimomura | 19/235 |

FOREIGN PATENT DOCUMENTS

| | | | |
|---|---|---|---|
| 3336812 | 6/1984 | Fed. Rep. of Germany . | |
| 0981471 | 12/1982 | U.S.S.R. | 19/239 |
| 933946 | 8/1963 | United Kingdom | 19/215 |
| 2061338 | 5/1981 | United Kingdom | 19/239 |
| 2081758 | 2/1982 | United Kingdom | 19/239 |

*Primary Examiner*—Werner H. Schroeder
*Assistant Examiner*—John J. Calvert
*Attorney, Agent, or Firm*—Kenyon & Kenyon

[57] ABSTRACT

The comber has at least one combing head comprising an oscillating nipper unit with an intermittently rotatable feed roller for advancing the lap feed to be combed in the combing head. An electric motor is provided to rotate the fed roller and is energized with drive pulses by a control unit. The magnitudes and phases of the drive pulses are adjustable in the control unit relative to the movements of the nipper unit. Consequently, the angle through which the feed roller rotates during a single reciprocation of the nipper unit and the instant of time of such rotation can be readily adjusted steplessly even with the comber runner. Also, a closed-loop control is possible if the angle through which the feed roller rotates is so adjusted in the control unit by a controller that the yarn count, as determined continuously by a sensor of the combed sliver deliver by the combing head always remains substantially constant.

21 Claims, 3 Drawing Sheets

COMBER WITH ELECTRIC MOTOR DRIVEN INTERMITTENT FEED ROLLER

This invention relates to a comber for textile machine.

Combers have been known which have at least one combing head comprising an oscillating nipper unit and in which an intermittently rotatable feed roller is mounted for advancing a lap feed to be combed in the combing head. In combers of this kind, the feed roller is driven by the opening or closing movement of the nipper unit which comprises a lower nipper and an upper nipper. That is, the feed roller is driven by the relative movement between the upper and lower nippers while the nipper unit oscillates between a withdrawn closed position and an advanced opened position. The feed roller is driven either during the forwards movement of the nipper unit—advance feeding—or during the return movement of the nipper unit—return feeding. However, it is difficult or complicated and time-consuming to vary the amount of feed i.e., the angle through which the feed roller rotates during each advance and return movement of the nipper unit (combing cycle). In many constructions, a change-over from advance feeding to return feeding or vice versa is possible but complex.

Examples of the various types of feed roller arrangements which have been used in combing machines are described in U.S. Pat. Nos. 3,277,790; 3,153,936 and 3,004,300 as well as German OS 3336812. In one case, a hydraulic apparatus is used for the intermittent rotation of a feed shaft. However, such a hydraulic apparatus requires a rather complex arrangement to change over from advance feeding to return feeding and vice versa. In other cases, ratchet gears are used in a mechanical arrangement which are relatively slow in operation and which require complex arrangements for changeover. In addition, changes in the amount of rotation of a feed roller cannot be readily achieved in a simple manner.

Accordingly, it is an object of the invention to be able to vary the amount of feed in a comber in a simple manner.

It is another object of the invention to be able to vary the feed of lap in a comber from time-to-time in a rapid manner.

It is another object of the invention to be able to control the rotation of a feed roller in a simple reliable manner.

Briefly, the invention provides a comber for a textile machine comprising an oscillating nipper unit for holding a lap to be combed, a rotatable feed roller mounted in the nipper unit for advancing a lap to be combed and an electric motor for intermittently rotating the feed roller.

The electric motor, for example, a stepping motor or servomotor, for driving the feed roller can be readily controlled by means of a simple control unit as to rotate the feed roller through a required angle during each advance or return movement of the nipper unit. If required, the feed roller can be rotated during both the advance and return movements i.e. mixed feeding. The amount of feed i.e., the angle through which the feed roller rotates during each combing cycle can be varied quite simply and without loss of time even with the comber running and, if required, steplessely if the lengths and/or amplitudes and/or numbers (in the case of a stepping motor) of the pulses energizing the electric motor are adjustable in the control unit. The latter pulses must, of course, be synchronised with the movements of the nipper unit i.e., they must always occur at the same time or times in each combing cycle. However, it is a simple matter to vary the position of such time or times in the combing cycle if the control unit is adapted to adjust the phases of the drive pulses relative to the movements of the nipper unit. Consequently, by means of an appropriate control unit, the feed roller can be rotated through an adjustable angle at an adjustable time during the advance movement of the nipper unit and/or at an adjustable time during the return movement of the nipper unit.

When the amount of feed is varied by the control unit, the speed of the lap feed to the combing head should, of course, be varied too. The control unit can therefore be so devised as to control not only the electric motor driving the feed roller but also means for driving a continuously rotating lap roller which unreels from a lap, i.e. the lap feed to be combed in the combing head. The surface speed of the lap roller should be such that the length unwound from the lap during a combing cycle is always substantially in the same relationship to the length advanced by the feed roller in the combing cycle.

Since adjustment of the amount of feed is so simple even with the comber running, closed-loop control is another possibility. In known combers and if the amount of feed is constant, the combed sliver delivered by the combing head may vary in yarn count if errors occur in the thickness of the lap feed or if the composition thereof and, therefore, of the noil vary. In order to obviate such variations in yarn count, a sensor can be provided which continuously senses the count of the delivered combed silver and transmits a corresponding signal as a regulating variable to a controller in which the control unit is incorporated and which adjusts the amount of feed to ensure that the count remains at least substantially constant.

In a comber having a number of combing heads, a sensor can be so disposed as to sense the count of the combined or doubled combed slivers delivered by the heads, possibly after drafting in a drawframe. In this event, the associated controller can provide a common adjustment of the amounts of feed of all the combing heads.

When a number of combing heads are provided, the feed roller of each combing head can have its own electric motor. All or some of the electric motors can be energized by a common control unit or an independent control unit can be associated with each electric motor. Another possibility is for the feed rollers of at least some of the combing heads to be coupled together and to be driven by a common electric motor. In this event, of course, it would be advisable to use for a closed-loop control, a sensor which determines the count of the combined combed slivers delivered by the coupled-together heads.

These and other objects and advantages of the invention will become more apparent from the following detailed description taken in conjunction with the accompanying drawings wherein.

Figure 1:
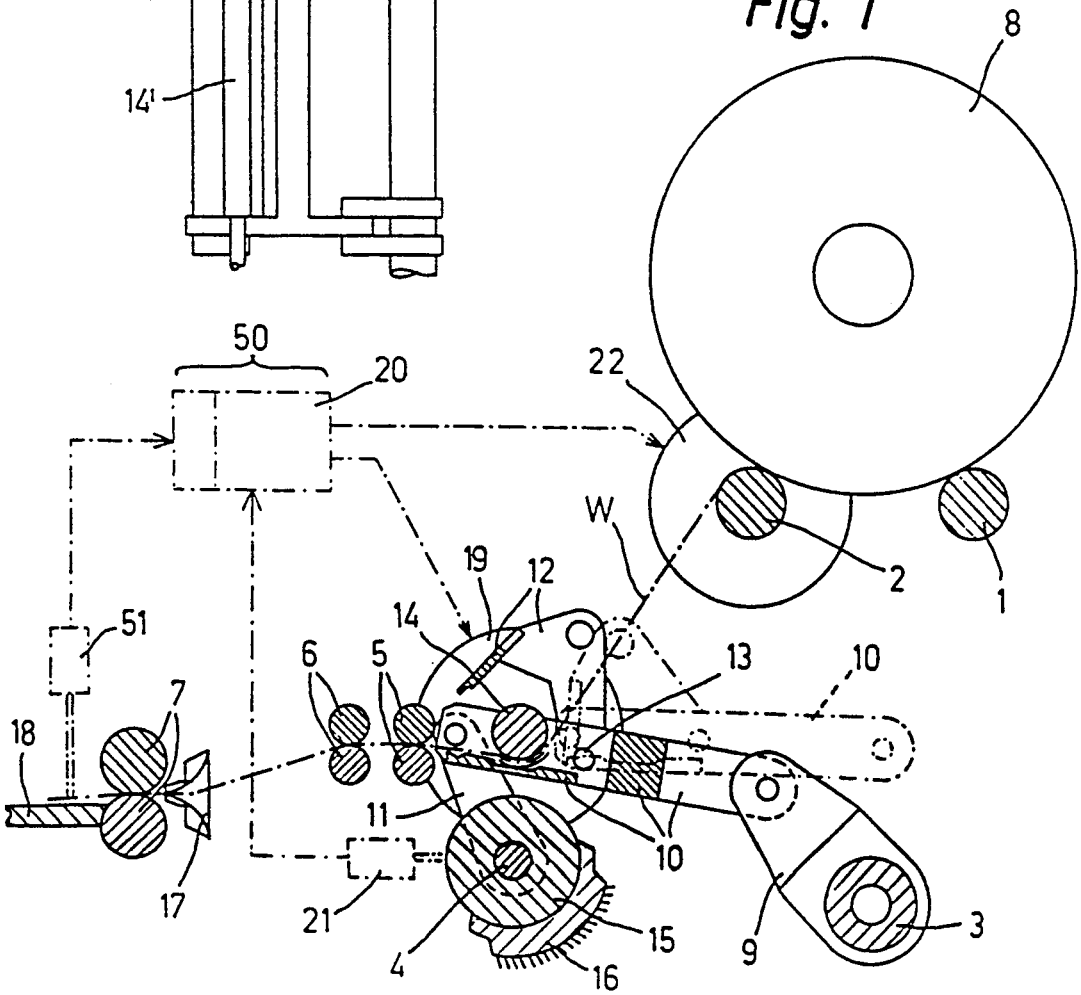
FIG. 1 illustrates a diagrammatic vertical sectional view through a combing head of a comber constructed in accordance with the invention.

Referring to FIG. 1, the combing head has, in conventional manner, two lap rollers 1, 2, a nipper shaft 3, a cylinder shaft 4, a first detaching roller pair 5, a second detaching roller pair 6 and a delivery roller pair 7 all mounted in a machine frame (not shown). In cperation, a lap 8 rests on the two rotatable lap roller 1,2.

The combing head also has an oscillating nipper unit mounted on the shaft 3 which is adapted to pivot in an oscillating manner and carries crank arms 9 to which the rear end of a lower nipper 10 is articulated. The front end of the lower nipper 10 is articulated to front supports 11 mounted for pivoting around the shaft 4. An upper nipper 12 is connected to the lower nipper 10 to pivot around a pivot 13 thereon. The oscillating rotation of the nipper shaft 3 and, therefore, of the crank arms 9 reciprocates the lower nipper 10 between a front position, shown in solid lines, and a rear position, shown in broken lines. When the lower nipper 10 is in the front position, the nipper unit 10, 12 is in an open state and when the lower nipper 10 is in a rear position, the nipper unit 10, 12 is in a closed state.

An intermittently rotatable feed roller 14 is mounted in the lower nipper 10 for purposes as described below.

The continuously rotating shaft 4 carries, in conventional manner, a cylinder 15 having a segment 16 which carries pins.

The lap feed W unwound from the lap 8 by rotation of the lap rollers 1, 2 moves to the feed roller 14 and therefrom into the nip of the nipper unit 10, 12.

With the lower nipper 10 in the rear position (shown in broken lines) the closed nipper unit 10, 12 presents to the rotating cylinder 15, 16 a tuft of the lap feed, such tuft being combed out by the segment 16. The lower nipper 10 then moves into a front position and the nipper unit 10, 12 opens. The combed-out tuft is drawn through a top comb (not shown) into the detaching cylinder pair 5 and combined therein with the previously combed lap feed. The nipper unit 10, 12 then returns to the rear position and the cycle restarts. The combed lap feed runs from the detaching cylinder pair 5 through the second detaching cylinder pair 6, a sliver funnel 17 and the delivery roller pair 7 and thereafter as combed sliver onto a delivery table 18, for example, of a drawframe.

During the movement of the lower nipper 10 from a rear position to a front position and/or during movement from the front position to the rear position, the feed roller 14 rotates through a predetermined adjustable angle in order to advance the lap feed by a predetermined amount relative to the lower nipper 10. To this end, an electric motor 19 rotates the feed roller 14. Conveniently, the motor 19 is a highly dynamic d.c. or three-phase motor, for example, a stepping motor or a servomotor.

A control unit 20 supplies the motor 19 with drive pulses synchronised with the movements of the nipper unit 10, 12. To this end, the control unit 20 is supplied, for example, with the output control signal of a position sensor 21 which, for example, by magnetic or optical means, scans the markings, for example, teeth, on an element (not shown) carried by the shaft 4 (the shaft 4 makes one revolution for each reciprocation of the nipper unit 10, 12).

The control unit 20 is so devised that the phases of the drive pulses are adjustable relative to the movements of the nipper unit 10, 12 so that the motor 19 rotates the feed roller 14 at an adjustable instant of time during the forwards movement of the nipper unit 10, 12 and/or at an adjustable unit of time during the return movement of the nipper unit.

The amount of feed i.e., the angle through which the motor 19 rotates the feed roller 14 during each forwards movement and/or each return movement of the nipper unit 10, 12 is also adjustable. To this end, the lengths and/or amplitudes of the drive pulses output by the control unit 20 are adjustable therein or, if the motor 19 is a stepping motor, the number of pulses delivered by the control unit 20 during each forwards movement and/or during each return movement of the nipper unit 10, 12 is adjustable in the control unit 20.

When the amount of feed is adjusted in the control unit 20, the speed of rotation of the lap rollers 1, 2 must be altered correspondingly. Consequently, a variable-speed electric motor 22, preferably a geared motor, is provided to drive the lap roller 2 (and possibly, by way of a coupling which is not shown, the lap roller 1 too) and the control unit 20 is adapted to supply the motor 22 with a current of such a voltage and/or frequency that the surface speed of the lap rollers 1, 2 is always in a substantially constant ratio to the average surface speed of the intermittently rotating feed roller 14.

Figure 2:
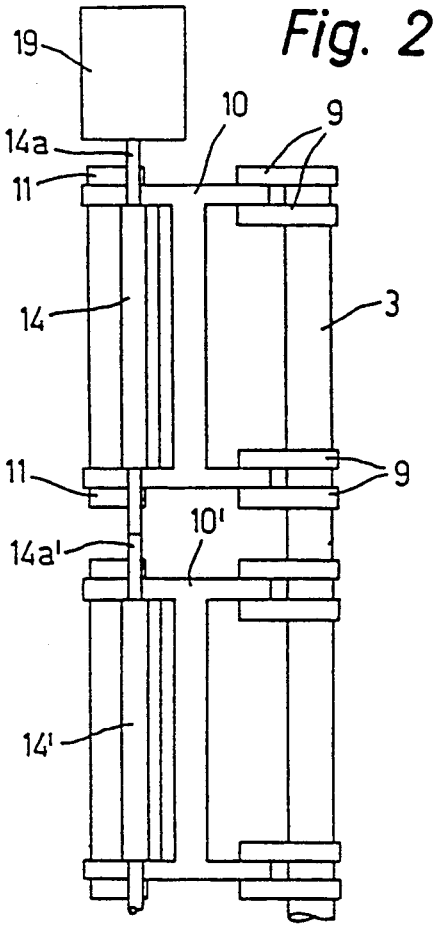
FIG. 2 illustrates a plan view to a scale smaller than that of FIG. 1 but showing only the lower nipper with the feed roller and a driving motor.

The electric motor 19 can be arranged in a variety of ways. In the embodiment shown in FIGS. 1 and 2, the motor 19 is secured, in a manner which is not shown, to the lower nipper 10 and arranged coaxially of the feed roller 14. The motor shaft is directly coupled with the feed roller shaft 14*a* (FIG. 2). An arrangement of this kind is suitable in the first place for a comber having only a single combing head. However, in a comber having a number of combing heads disposed in a row, the feed rollers of some or all of the combing heads can be driven by a common electric motor arranged coaxially of the feed rollers. To this end, the shafts of the feed rollers of the combing heads would simply have to be coupled together. This is shown in FIG. 2 for a sècond combing head, only the lower nipper 10' and feed roller 14' or which are shown. Shaft 14*a*' of feed roller 14' is coupled with shaft 14*a* of feed roller 14.

Figure 3:
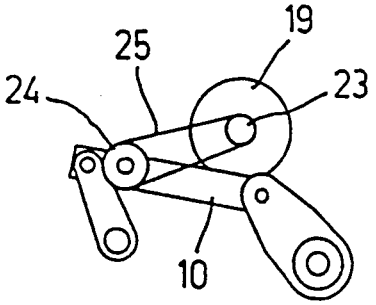
FIG. 3 illustrates a diagrammatic side view of a lower nipper of a modified comber constructed in accordance with the invention.
Figure 4:
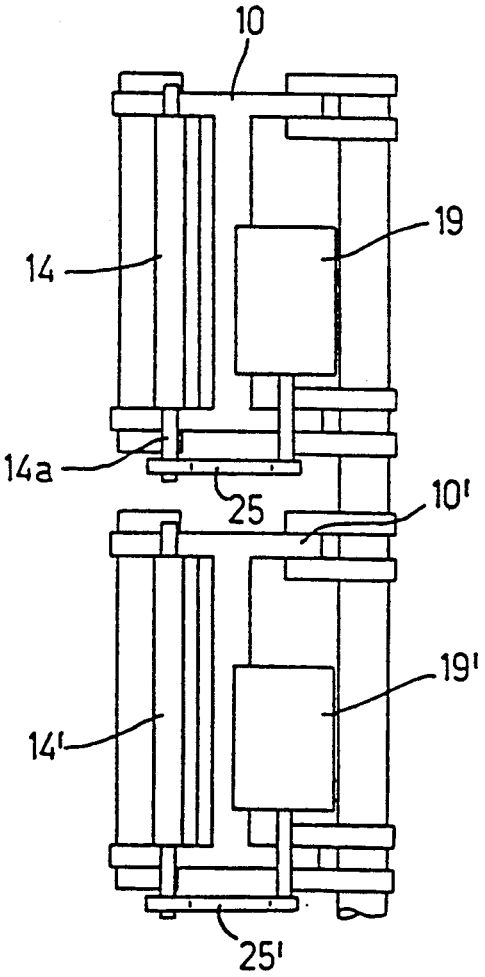
FIG. 4 illustrates a plan view of the comber of FIG. 3.

Referring to FIGS. 3 and 4, the motor 19 may be secured to the lower nipper 10 in parallel to and at a distance from the feed roller 14. In this case, a transmission connects the motor 19 to the feed roller 14. For example, the transmission has a gear 23 on the shaft of the motor 19 connected by way of a toothed belt 25 to a gear 24 on the feed roller shaft 14*a*. In this arrangement, each combing head of a multihead comber can have its own feed roller drive motor.

FIG. 4 shows the lower nipper 10' of a second combing head having an independent motor 19' coupled by way of a toothed belt 25' with the feed roller 14'. The feed roller drive motors of each of the various combing heads can each be energized by an independent control unit 20 (FIG. 1) or a common control unit can energize some or all of the motors. Another possibility, of course, would be to omit the feed roller drive motor from some of the combing heads and to couple the particular feed rollers concerned with the feed roller of an adjacent head (similarly to what is shown in FIG. 2).

Figure 5:
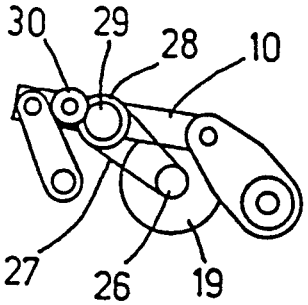
FIG. 5 illustrates a diagrammatic side view of a lower nipper of a further modified comber in accordance with the invention.
Figure 6:
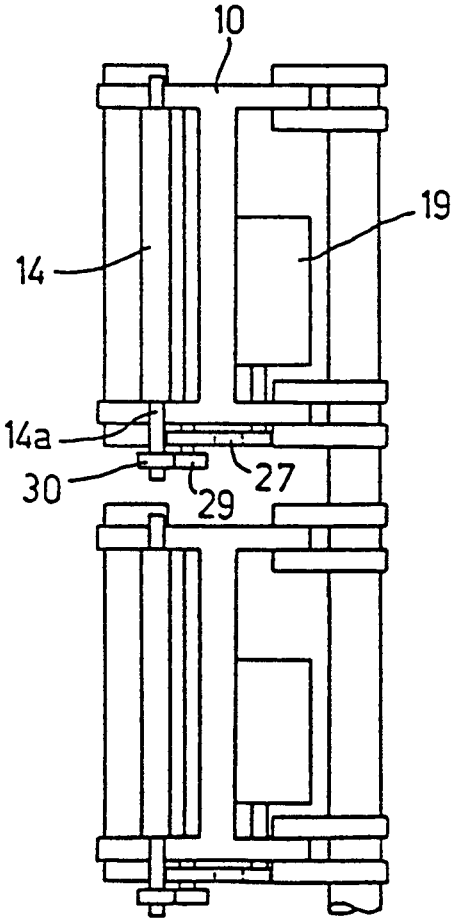
FIG. 6 illustrates a plan view of the comber of FIG. 5.

Referring to FIGS. 5 and 6, the motor 19 can be as in FIGS. 3 and 4, secured to the lower nipper 10 at a distance from the feed roller 14 but coupled therewith in a different way. A gear 26 on the motor shaft drives, by way of a toothed belt 27, an intermediate gear 28 rotatably mounted, for example, on pivot 13 of the upper nipper 12 (FIG. 1). A gear 29 is rigidly connected to the gear 28 and meshes with a gear 30 disposed on the feed roller shaft 14*a*. The gear 29 could be replaced by a toothed segment which is merely pivoted forwards and backwards by the motor 19 subject to the provision between the gear 30 and the shaft 14*a* of a free wheel (not shown) which drives the feed roller 14 only on the forwards pivoting movement of the segment. The motor 19 might in some circumstances be disposed directly on the shaft of the gear or segment 30, in which event the gears 26, 28 and the toothed belt 27 would be omitted. In other respects, the possibilities described for the variant shown in FIGS. 3 and 4 are effective for the variant shown in FIGS. 5 and 6.

Figure 7:
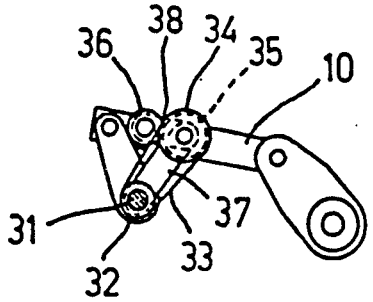
FIG. 7 illustrates a diagrammatic side view of a still further modified comber in accordance with the invention.
Figure 8:
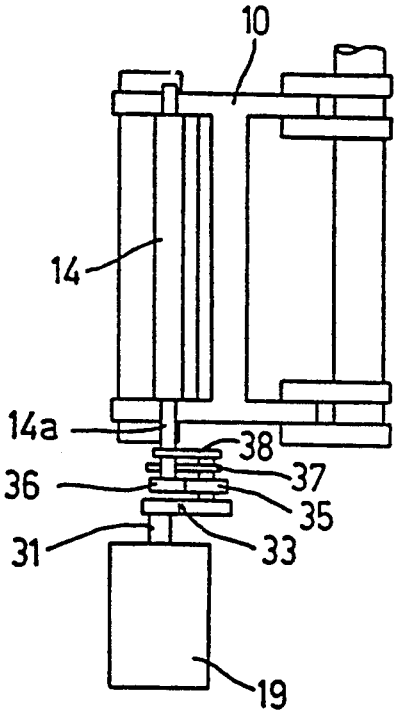
FIG. 8 illustrates a plan view of the comber of FIG. 7 with a motor mounted on a frame of the comber in accordance with the invention.

In the embodiments hereinbefore described, the motor 19 is secured to the lower nipper 10. However, the motor 19 can be rigidly disposed on the comber frame, in which event the motor 19 does not have to move with the nipper unit and the supply wiring to the motor can be fixed. FIGS. 7 and 8 show a corresponding variant in which the motor 19 is rigidly disposed on the frame coaxially of the shaft 4 (FIG. 1). The motor 19 is shown only in FIG. 8. A gear 32 of a transmission is secured to the motor shaft 31 and coupled by way of a toothed belt 33 with an intermediate gear 34. A gear 35 is rigidly connected thereto and meshes with a gear 36 on the feed roller shaft 14*a*. To ensure that the intermediate gear 34 and the gear 35 always remain at the same distance from the motor shaft 31 and the feed roller shaft 14*a* during the movement of the nipper unit, the gears 34, 35 are mounted in overhung fashion i.e., each at one end of two links 37, 38 whose other ends are mounted for pivoting around the motor shaft 31 or around the cylinder shaft 4 coaxial thereof or around the feed roller shaft 14*a*. If the feed roller shaft 14*a* were to move in a concentric orbit around the axis of the cylinder shaft 4 during nipper movement, the overhung gears 34, 35 could be omitted and a gear on the motor shaft 31 could directly engage the gear 36 on the feed roller shaft 14*a*. The movements of the nipper unit cause the intermediate gear 34 to be reciprocatingly rotated by the toothed belt 33 when the motor 19 is stationary.

Consequently, the control unit 20 (not shown) has to make the motor 19 oscillate in synchronism with the nipper movement outside the periods of the drive pulses output to rotate the feed roller 14 that the roller 14 does not rotate relative to the lower nipper 10.

When a comber of the variant shown in FIGS. 7 and 8 comprises a number of combing heads disposed in a row, the feed shafts 14*a* of adjacent heads could be coupled together roller just as in FIG. 2. However, the motor shaft 13 can extend through a number of combing heads and carry, in each head, a gear 32 which drives the particular feed roller 14 concerned by way of its gears 34–36. The cylinders 15 (FIG. 1) of the various heads could be rotatably mounted on the shaft 31 separately from one another and driven separately, for example, by way of toothed belts.

Figure 9:
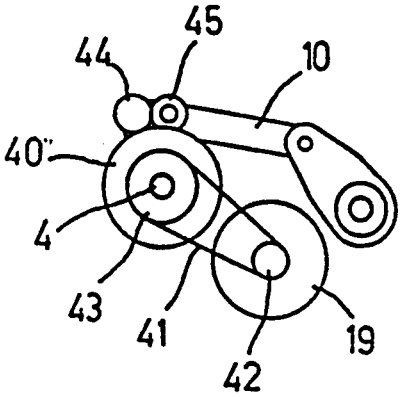
FIG. 9 illustrates a still further modified comber in accordance with the invention.
Figure 10:
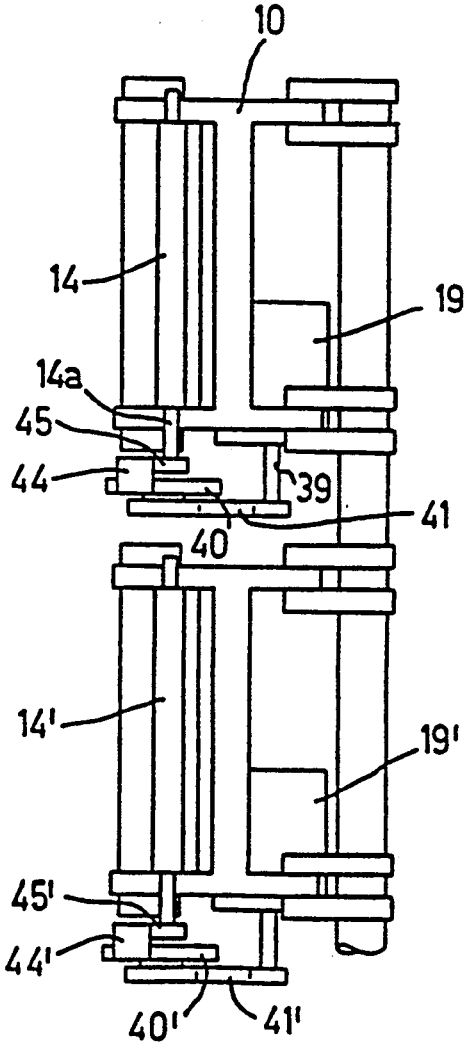
FIG. 10 illustrates a plan view of the comber of FIG. 9.

Referring to FIGS. 9 and 10' the motor 19 is rigidly disposed on the frame at a distance from and parallel to the cylinder shaft 4. A motor shaft 39 is connected to a gear 40 rotatably mounted on the cylinder shaft 4 by transmission means, for example, by way of a toothed belt 41 and toothed-belt gears 42, 43 as shown, the gear 43 being rigidly connected to the gear 40. The gear 40 engages a pinion 44 rotatable about the pivot connecting the lower nipper 10 to the front supports 11 (FIG. 1). The pinion 44 meshes with a gear 45 secured to the feed roller shaft 14*a*. In this variant the movements of the nipper unit reciprocate the pinion 44 and, therefore, the gear 45 and the feed roller 14 when the motor 19 and gear 40 are stationary. Consequently, the control unit energizing the motor 19 must make the motor 19 rotate reciprocatingly in synchronism with the nipper movement outside the periods of the drive pulses to ensure that the feed roller does not rotate relatively to the lower nipper 10. In this variant, each head of a multi-head comber can have an independent feed roller drive motor FIG. 10 shows the lower nipper of a second combing head having its own motor 19' coupled with the feed roller 14' by way of a toothed belt 41', 40', pinion 44' and gear 45'. The feed roller drive motors of the various heads can be supplied by an independent control unit or a common control unit can energize some or all of the motors.

In the control unit 20 (FIG. 1) which in all the variants described energizes one or more feed roller drive motors 19 or 19', the amount of feed i.e., the angle through which the motor 19 or 19' rotates the feed roller 14, 14' respectively during each forwards movement and/or during each return movement of the nipper unit 10' 12 is adjustable. If the control unit is constructed appropriately, the amount of feed can be adjusted by means of an e.g. electrical control signal. Closed-loop control is therefore a possibility. As shown diagrammatically in FIG. 1, the control unit 20 can be part of a controller 50 receiving, as a regulating variable, the yarn count, continuously determined by a sensor 51, of the combed sliver delivered by a combing head to the delivery table 18. This holds good when the comber has only one combing head or when in a multihead comber each head has its own feed cylinder drive motor 19 or 19' in each case with its own control unit 20. In this event, each head has its own controller 50 and sensor 51. However, when a common control 20 energizes a number of such motors or when the feed rollers of a number of heads are coupled together and driven by a common motor 19, the sensor 51 is, conveniently, adapted to detect the yarn count of a combination of comb slivers delivered by the number of heads and to supply the count as a regulating variable to the controller 50. Conveniently, the detector can, in this case, be disposed after a drawframe (not shown) in which the combed slivers which are delivered by the given number of combing heads and which are combined on the table 18 are given joint drafting treatment.

The controller 50 acts in the control unit so to adjust the amount of feed for one combing head or for a number of combing heads that the yarn count of the combed sliver delivered by the combing head or the combination of combed slivers delivered by the combing heads always remains substantially constant despite errors in the thickness of the supplied lap feed W or variations in the composition of the lap feed and, therefore, of the noil.

The invention thus provides a comber in which the rotation of a feed roller can be readily controlled in a minimum of time. Further, the invention provides a comber which is able to regulate the feed of a feed roller in dependence upon the yarn count of the comb slider produced by the comber.

What is claimed is:

1. A comber comprising at least one combing head including an oscillating nipper unit and a rotatable feed roller for advancing a lap to be combed;

an electric motor for intermittently rotating said feed roller; and a control unit for energizing said motor with drive pulses in synchronism with the movements of said nipper unit.

2. A comber as set forth in claim 1 wherein said control unit is adapted to adjust the phases of said drive pulses relative to the movements of said nipper unit.

3. A comber as set forth in claim 2, wherein said drive pulses are adjustable in at least one of the length, amplitude and number thereof.

4. A comber as set forth in claim 3, which further comprises a lap roller for feeding a lap to said combing head and a drive means for driving said lap roller connected to said control unit to be controlled thereby.

5. A comber as set forth in claim 1 wherein said motor is mounted on said nipper unit.

6. A comber as set forth in claim 5 wherein said motor is coaxial of said feed roller.

7. A comber as set forth in claim 1 wherein further comprises a frame mounting said combing head and said motor thereon and an transmission connecting said motor with said feed roller.

8. A comber as set forth in claim 1 further comprising a plurality of said combing heads, said electric motor being connected in common to said feed roller of each said combing head.

9. A comber as set forth in claim 1 which further comprises a sensor for generating a control signal in response to the sensed yarn count of a combed sliver delivered from said combing head, said sensor being connected to said control unit to deliver said signal thereto for adjusting at least one of the length, amplitude and number of said drive pulses in response thereto to maintain a constant yarn count.

10. A comber as set forth in claim 9 which further comprises a plurality of combing heads and a plurality of said motors connected to respective feed rollers, said motors being connected in common to said controller.

11. A comber as set forth in claim 1 further comprising a plurality of said combing heads, said electric motor being connected in common to said feed roller of each said combing head, and a sensor for generating a control signal in response to the sensed yarn count of a plurality of combed slivers delivered form said combing heads said sensor being connected to said control unit to deliver said signal thereto for adjusting at least one of the length, amplitude and number of said drive pulses in response thereto to maintain a constant yarn count.

12. A comber as set forth in claim 11 wherein said sensor is disposed downstream of a drawframe to which the combed slivers are fed in common.

13. A comber comprising an oscillating nipper unit for holding a lap to be combed;

a rotatable feed roller mounted in said nipper unit for advancing a lap to be combed; and an electric motor for intermittently rotating said feed roller.

14. A comber as set forth in claim 13 which further comprises a control unit for energizing said mount in synchronism with the oscillating movements of said nipper unit.

15. A comber as set forth in claim 14 which further comprises a lap roller for feeding a lap to said combing head and a drive means for driving said lap roller connected to said control unit to be controlled thereby.

16. A comber as set forth in claim 14 wherein said motor is mounted on said nipper unit.

17. A comber as set forth in claim 14 which further comprises a frame mounting said combing head and said motor thereon and an transmission connecting said motor with said feed roller.

18. A comber as set forth in claim 13 which further comprises a controller having a control unit for energizing said motor with drive pulses in synchronism with the movements of said nipper unit and a sensor for generating a control signal in response to the sensed yarn count of a combed sliver deliver from said combing head, said sensor being connected to said controller to delivered said signal thereto for adjusting said motor to maintain a constant yarn count.

19. A comber as set forth in claim 18 which further comprises a plurality of combing heads and a plurality of said motors connected to respective feed rollers, said motors being connected in common to said controller.

20. A comber comprising at least one combing head including an oscillating nipper unit and a rotatable feed roller for advancing a lap to be combed;

an electric motor for intermittently rotating said feed roller;

a control unit for energizing said motor with drive pulses in synchronism with the movements of said nipper unit;

a lap roller for feeding a lap to said combing head; and drive means for driving said lap roller connected to said control unit to be controlled thereby.

21. A comber as set forth in claim 20 which further comprises a sensor for generating a control signal in response to the sensed yarn count of a combed sliver delivered from said combing head, said sensor being connected to said control unit to deliver said signal thereto for adjusting at least one of the length, amplitude and number of said drive pulses in response thereto to maintain a constant yarn count.

* * * * *